United States Patent [19]

Arsenian

[11] Patent Number: 4,669,723

[45] Date of Patent: Jun. 2, 1987

[54] SKI TRAINER

[75] Inventor: John J. Arsenian, Trumbull, Conn.

[73] Assignee: Panaram Alpine Corporation Inc., Lyndhurst, N.J.

[21] Appl. No.: 788,071

[22] Filed: Oct. 16, 1985

[51] Int. Cl.[4] ..... A63B 69/18

[52] U.S. Cl. ..... 272/97

[58] Field of Search ..... 272/97, 144, 127, 70

[56] References Cited

U.S. PATENT DOCUMENTS

| | | |
|---|---|---|
| 3,274,081 | 2/1942 | Mautin . |
| 3,364,875 | 1/1968 | Bilaisis . |
| 3,467,374 | 9/1969 | Auer . |
| 3,575,412 | 4/1971 | Arsenian et al. . |
| 3,591,172 | 7/1971 | Hude . |
| 3,650,528 | 3/1972 | Natterer . |
| 3,704,885 | 12/1972 | Raciunas . |
| 3,707,283 | 12/1972 | Cormier . |
| 3,708,163 | 1/1973 | Hynes . |
| 3,807,727 | 4/1974 | Ferguson . |
| 4,376,532 | 3/1983 | Hunstad . |
| 4,429,869 | 2/1984 | Eckstein . |
| 4,607,839 | 8/1986 | Knudson ..... 272/97 |

FOREIGN PATENT DOCUMENTS

| | | |
|---|---|---|
| 2443695 | 3/1976 | Fed. Rep. of Germany . |
| 832295 | 9/1938 | France . |
| 2262362 | 9/1975 | France . |
| 886917 | 12/1981 | U.S.S.R. . |

*Primary Examiner*—Richard J. Apley
*Assistant Examiner*—S. R. Crow
*Attorney, Agent, or Firm*—Mattern, Ware, Stoltz & Fressola

[57] ABSTRACT

A skier's exercise trainer has a base providing a front support and right and left rear lateral supports, with a transverse rear track portion extending laterally between the lateral supports. A pair of elongated ski plates are positioned side by side overlying the base with their front ends rockably and pivotally mounted near the front support of the base, and their rear ends spaced above the rear track. A truck assembly is rockably joined to the underside of the rear end of each ski plate, with an elongated tie bar pivotally connected to the underside of each truck, and a rolling support is rotatably secured to each truck in rolling contact with the rear track. A tension-carrying cable has a rear end connected to the central portion of the tie bar and extends forward under the ski plates between a pair of guide rollers rotatably mounted on the base in front of the tie bar. An adjustable tension spring assembly connects the front end of the base to the forward end of the tension-carrying cable. The device enables a user standing on the ski plates, by shifting his weight to apply pressure to the "uphill" ski, and changing "edge set" to establish reverse turn. The device thus simulates the motions of a downhill skier making a slalom-style run, with the spring assembly simulating the edging force produced by snow.

15 Claims, 15 Drawing Figures

FIG. 3
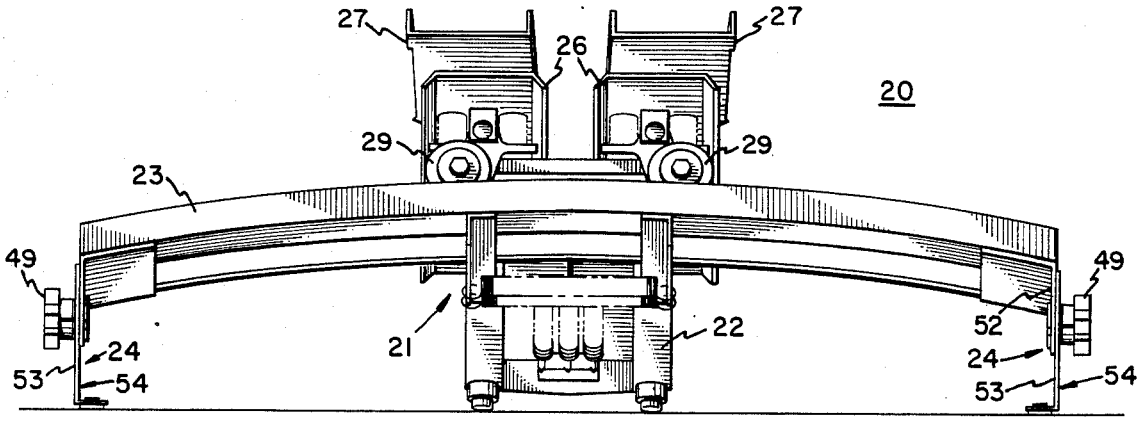
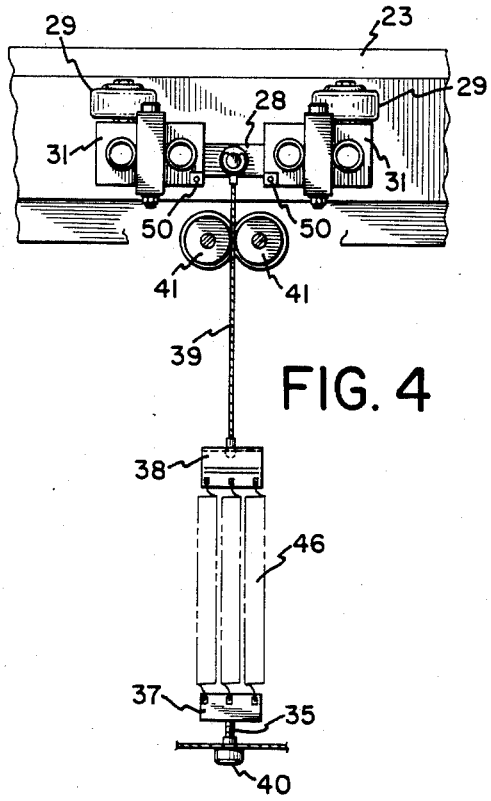
FIG. 4
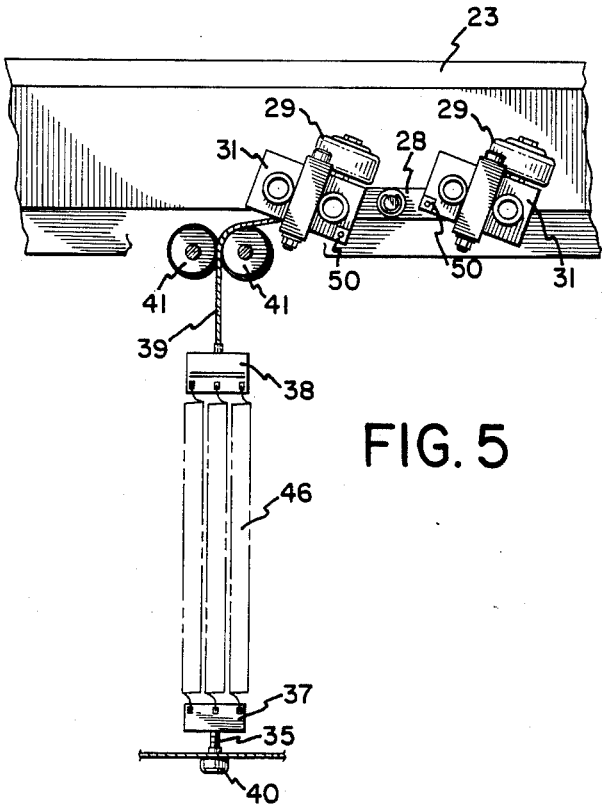
FIG. 5
FIG. 6
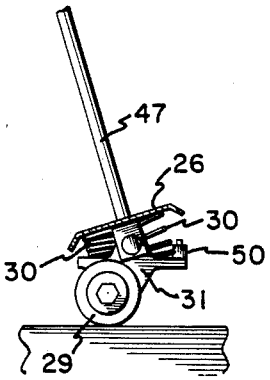

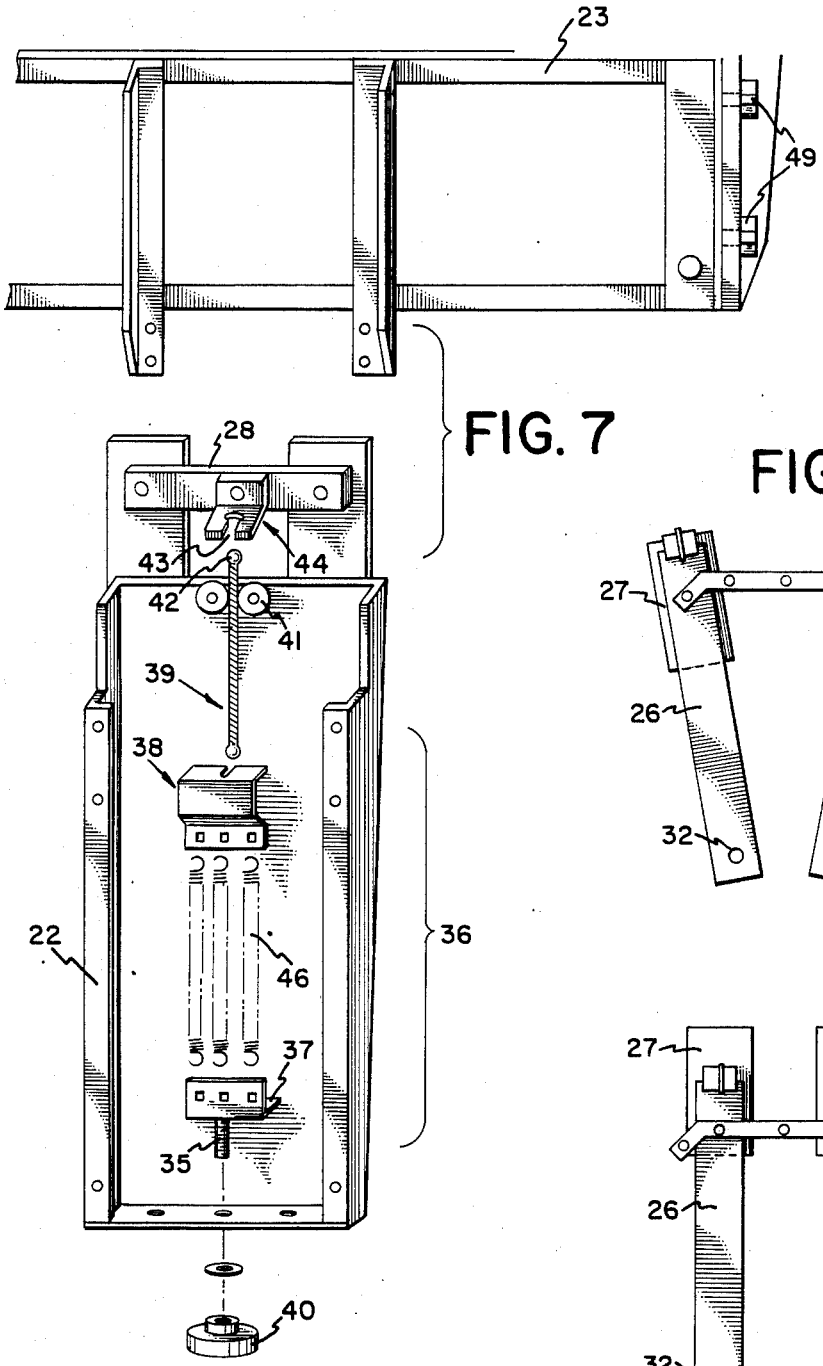
FIG. 7
FIG. 8
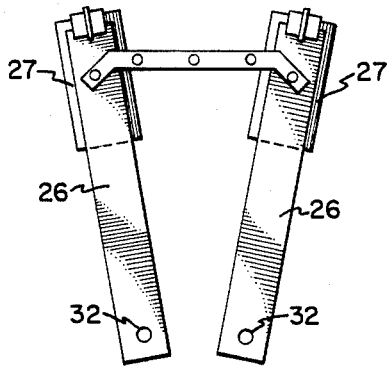
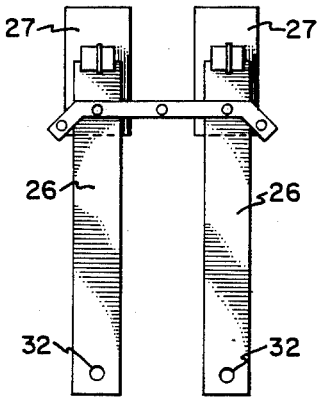
FIG. 9

SKI TRAINER

This invention relates to training and exercising devices for skiers and particularly to laterally pivoting movable platforms for supporting a skier in a standing or crouching position and affording him the opportunity to move his feet and legs from side to side, simulating slalom-style downhill skiing movements and thus maintaining his coordination, skill and muscle tone at high levels when his local climate conditions do not permit snow skiing.

Many different skiers' exercising devices are proposed in issued patents, including the present inventor's Arsenian, et al U.S. Pat. No. 3,575,412 issued Apr. 20, 1971. Single or double skier-supporting platforms, pivoted for angular side to side oscillating movement, are shown in a number of patents, such as U.S. Pat. Nos. 3,650,528, 3,591,172, 3,575,412, 3,467,374, 3,364,875, and 2,274,081 as well as French No. 832,295 and U.S.S.R. No. 886,917.

A number of these side to side oscillating pivoted platforms have rollers or wheels traveling on a flat rear track or surface such as U.S. Pat. Nos. 3,575,412, 3,807,727, 3,707,283, 3,650,528 and 3,591,172. Other patents show an upwardly arched or a curved track, supporting wheels or rollers on which such an oscillating platform travels, such as U.S. Pat. Nos. 3,364,875, 3,467,374, 2,274,081, French No. 832,925 and U.S.S.R. No. 886,917.

In addition, various United States patents show separate platforms on which the user is supported, which are capable of tilting independently from side to side, simulating the side to side rocking movement of the downhill skier's boots as he swings from side to side, slalom fashion, and as he "banks" inward at the outer lateral extremes of each swing. These patents are exemplified by U.S. Pat. Nos. 4,429,869, 4,376,532, 3,807,727, 3,708,163, 3,704,885 and French publication No. 2,262,362.

Skiers' exercise and practice devices are shown in each of these patents, and the lateral oscillating movement may be counteracted by centering springs acting to restore the oscillating platform toward the center of its path of travel, as indicated in German No. 2,443,695.

These conventional skiers' practice devices have all suffered from many disadvantages, and particularly from the lack of adjustability and flexibility. Any self-centering spring action has been either too forceful or too weak to simulate the lateral resistance force provided by snow on a skier's actual downhill slalom run. The desirable capability of providing skier-supporting platforms offering both parallel ski boot support and wedging support, with the ski boot axes converging at an acute angle, has been a capability lacking in these conventional devices. By offering a choice between two or even an infinite plurality of angular orientations of ski boot axes, and by providing readily adjustable lateral resistance force through a selection of different component springs, the adaptability of the device to skiers of different sizes, weights, ages and levels of skill has been remarkably enhanced in the present invention In addition, a realistic simulation of lateral resistance snow force or "edging" force is achieved in these devices Vertical indicator rods positioned close to the skier's normal line of sight facing downhill show the inclination angles of his respective ankles, allowing him to make immediate adjustments and to achieve the desired ankle position throughout his simulated run.

Quick assembly of components provide quick changes between the various wedging angles and "edging" force values made available by these devices. Adjustable rear side supports provide simulation of cross-slope diagonal downhill runs in either direction desired. A longitudinal track on which the training devices of the invention can be mounted optionally for rolling forward motion may be employed if desired to enhance the realism of the skier's simulated run.

Accordingly, a principal object of the present invention is to provide skiers training and exercise devices affording realistic simulations of many different downhill skiing conditions Another object of the invention is to provide such ski training devices offering widely adjustable variations in choices of skiing conditions to be simulated.

Still another object is to provide such ski training and exercise devices affording ready adjustment of the convergence angle between the skier's boots supported on the device.

A further object of the invention is to provide ski training devices on which the self-centering force simulating lateral resistance or "edging" snow forces may be adjusted through a wide variation of values.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

For a fuller understanding of the nature and objects of the invention, reference should be had to the following detailed description taken in connection with the accompanying drawings, in which:

THE DRAWINGS

FIG. 3 is a rear elevation view of the same device, showing it self-centering spring assembly.

FIGS. 4 and 5 are successive fragmentary top plan views taken along the line 4—4 shown in FIG. 2, and broken away to illustrate the operation of the self-centering spring assembly in simulating edging snow forces tending to return the ski trainer to its central rest position.

FIG. 6 is a fragmentary schematic rear elevation view showing the rocking truck assembly and roller resting on the rear track of the device.

FIG. 7 is a fragmentary exploded bottom view showing the front housing and rear track of the device disassembled, and the self-centering spring assembly disconnected and positioned ready for assembly.

FIGS. 8 and 9 are successive schematic bottom views of the underside of the ski plates of the device, showing them connected to the dual-purpose tie bar at two different connection points to provide wedging and parallel alignment respectively.

Figure 1:
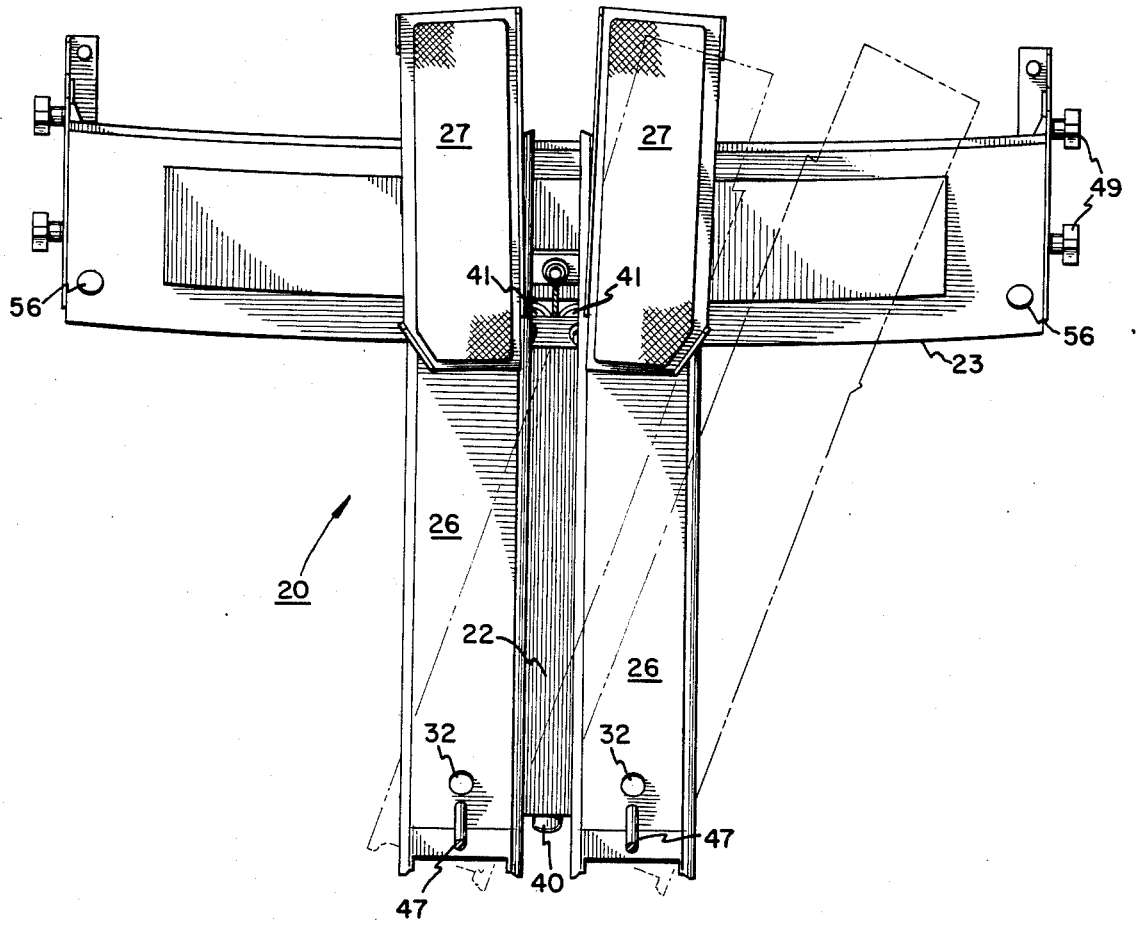
FIG. 1 is a top plan view of a skier's exercise trainer device incorporating the present invention.

The skier's exercise trainers 20 of the present invention are constructed of several sub-assemblies. These are mounted on a base housing 21 having a T-shaped configuration, formed as an elongated front housing 22 whose forward end rests on the floor and having an elevated rear end anchored to a rear track 23 slightly arched upward which has its ends adjustably supported above the floor by height adjuster end mounts 24.

A pair of right and left ski plates 26 simulating skiis are mounted above and pivotally secured to the front housing 22, with their forward ends positioned by vertical pivot assemblies 32 about which each of the ski plates 26 is free to swing laterally. Atop the rear end of each ski plate is a foot plate 27 on which the skier stands, wearing his shoes or ski boots, and the rear ends of ski plates 26 beneath foot plates 27 are arranged together by a pivoted tie bar 28 mounted on rollers 29, allowing him to move from side to side across the lateral length of the rear track 23 forming the cross bar of the T-shaped base housing 21.

Figure 2:
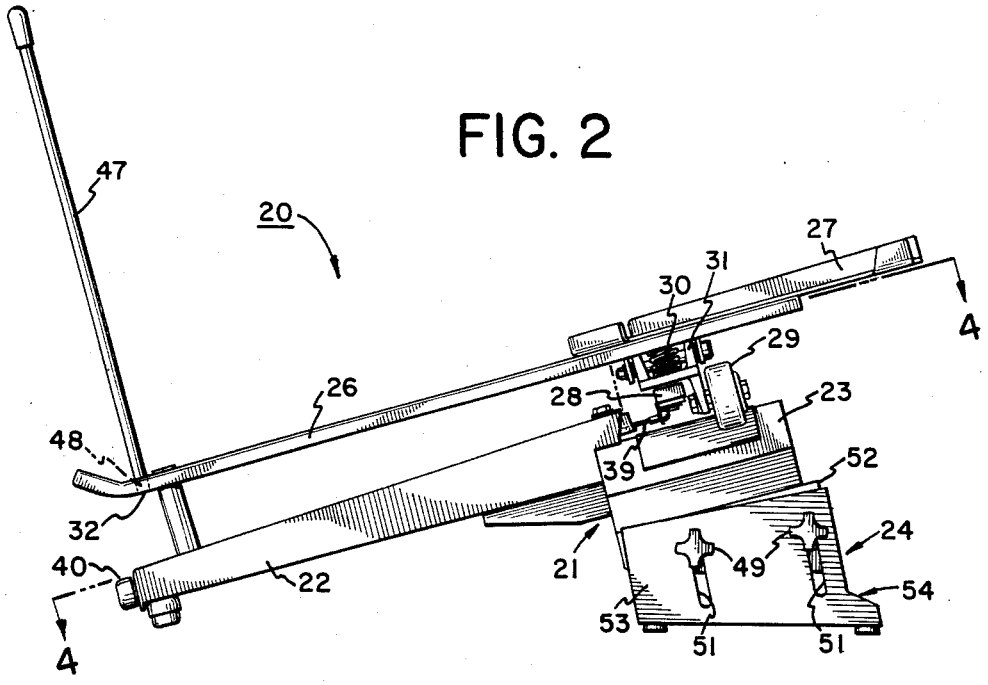
FIG. 2 is a side elevation view of the same training device.
Figure 14:
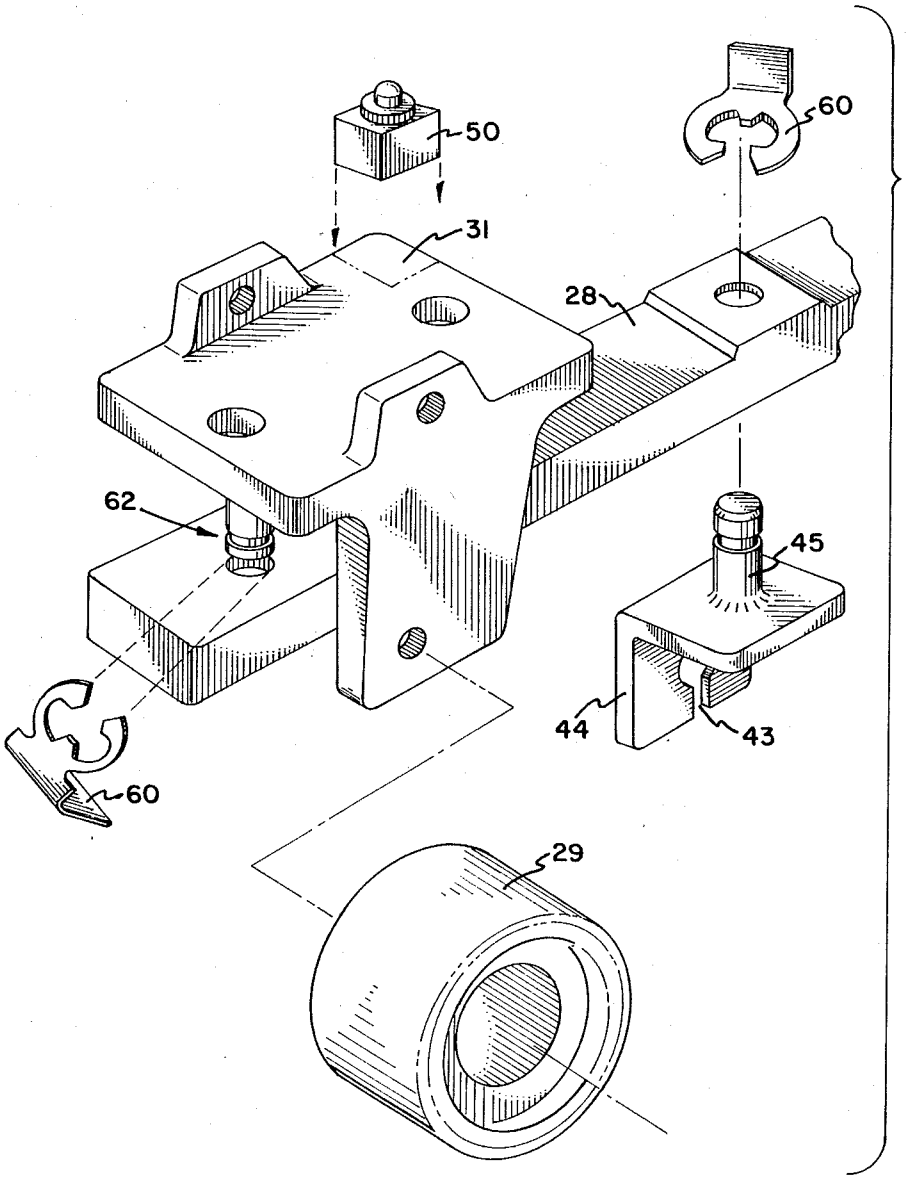
FIG. 14 is a fragmentary exploded perspective view showing the rocking truck and the standard tie bar in the process of assembly.

Thus the skier standing on foot plates 27 may shift his weight from side to side, causing ski plates 26 to pivot together about their respective front pivot mounts 32 relative to base housing 21. Tie bar 28 is pivotally anchored to a truck 31 at each end by a post 62 and snap ring 60. The truck 31 is provided with a wheel or roller 29, as shown in FIGS. 2, 6 and 14, supporting the assembly for rolling lateral movement across the lateral length of rear track 23. Rollers 29 are similar to roller-skate rollers, being bolted to a depending flange of truck 31 on sturdy low-friction roller bearings not illustrated in the drawings. Each ski plate 26 is movably secured to the underlying end of the tie bar on such a resilient spring-carrying rolling truck 31, and a pair of compression springs 30, clamped between each ski plate 26 and its truck 31 permit the plate to rock from side to side, as shown in FIG. 6.

Figure 13:
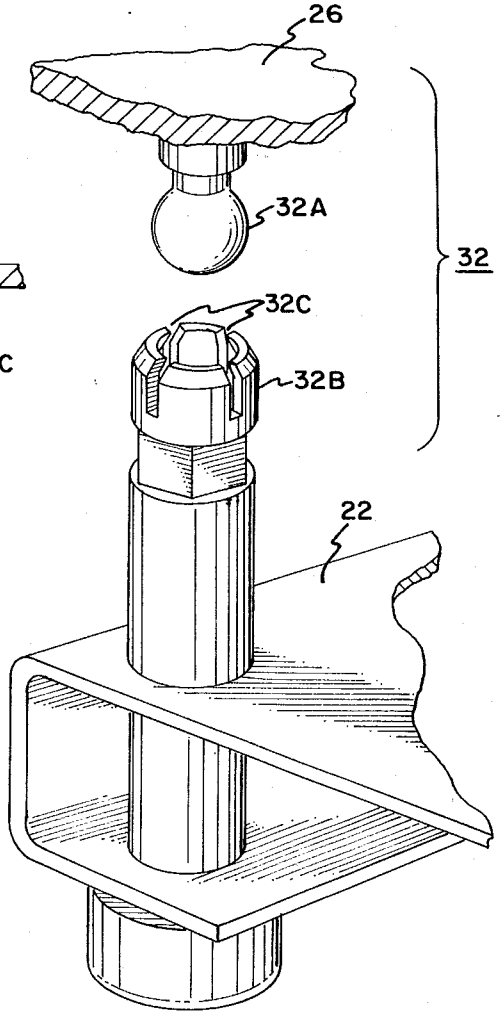
FIG. 13 is a corresponding fragementary perspective view showing a portion of this rocking, pivoting assembly.
Figure 12:
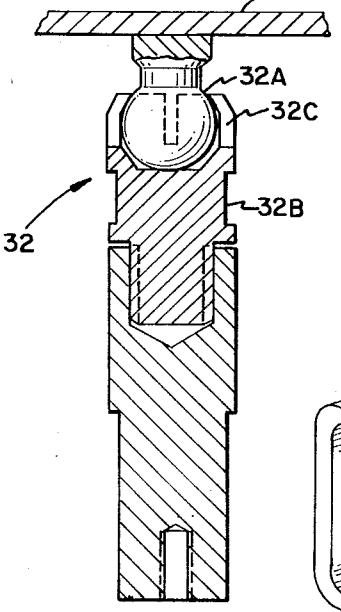
FIG. 12 is an enlarged cross-sectional elevation view showing the rocking, pivoting front support of the ski plate on the front housing.

The pivot mounting 32 at the forward end of each ski plate 26 securing it to front housing 22 provides a universal or ball and socket mounting. This permits the entire ski plate to rock from side to side, i.e., to pivot angularly about its own longitudinal axis passing through truck 31 and its forward pivot mounting 32. The device thus simulates the rocking, banking or "edging" motion of the skiis which is most pronounced toward the outermost lateral excursions of the side to side slalom swings in the skier's downhill run. As shown in FIGS. 12 AND 13, the pivot mounting 32 is preferably formed by a depending ball 32A seated in a socket portal formed in the open upper end of a hollow tubular column 32B whose open end is provided with short axial slots 32C, converting the column walls between slots 32C into spring fingers resiliently clamping ball 32A in the socket portal.

The ski plates 26 and the tie bar 28 are pivotally secured together by the rocking trucks 31 so that plates 26 pivot together about their respective pivot points 32 as a ganged assembly, as shown in FIGS. 1 and 5, simulating the parallel skiis of the downhill skier, while at the same time independently rocking sidewise about their respective longitudinal axes to simulate the rocking, tilting motion of the skiis during the skier's edging turns.

An alternative longer wedging tie bar, or an adjustable tie bar 34, or a dual-purpose tie bar 58 may be readily substituted for tie bar 28, spacing the rear ends of ski plates 26 further apart while their front pivots 32 remain in the same positions, thereby simulating the wedging, braking action of a skier decelerating on a straight downhill run.

An adjustable tie bar 34 may be used if desired, to be substituted for tie bar 28, and the trucks 31 may be adjustably moved outward further apart or inward closer together away from the ends of the adjustable tie bar 34, changing the converging or wedging angle between ski plates 26 as desired.

The restoring force tending to recenter the ski plates 26, from their outermost lateral excursions toward their central position above front housing 22, is supplied by an adjustable spring assembly 36.

As shown in the drawings, the spring assembly 36 is composed of a pair of spring anchor plates, a front anchor plate 37 centrally and adjustably secured to the forward end of the front housing 22, on a threaded tension-adjuster post 35 cooperating with an adjustment knob 40 threaded thereon, and a movable rear spring anchor plate 38 connected by a central cable 39 passing between two guide rollers 41 pivotally mounted on the underside of front housing 22 to terminate in a terminal knob 42 detachably secured in a knob slot 43 formed in a depending pivoting angle flange 44 extending downward from the central underside of the tie bar 28, 33 or 34. As shown in FIG. 14, angle flange 44 is pivotally secured to tie bar 28 by a grooved pivot pin 45 secured by a C-ring or snap ring 60 with an integral bent handle tab for convenient installation and removal.

The normal position of knob slot 43 in angle flange 44 is slightly to the rear of the guide rollers 41 positioned at the rear end of front housing 22, as shown in FIG. 4. Thus, in the central region of oscillating lateral travel of ski plates 26, the displacement of the ski plates and the connecting tie bar bends cable 22 through increasing angles, drawing the rear spring anchor plate 38 progressively away from its normal position spaced to the rear of front spring anchor plate 37, and slightly extending tension coil springs 46 joining the two anchor plates 37 and 38. Cable 39 may be made of stranded stainless steel, polymer coated if desired for protection and lubricity. Cable 39 may be replaced if desired by a bicycle-style sprocket-type chain, preferably with oversize pivot posts riding on oversize guide rollers 41.

A series of three spring anchor holes is arrayed along the forward edge of rear spring anchor plate 38 and along the rear edge of front spring anchor plate 37. From one to three tension springs may be employed to vary the self-centering edging force supplied by the device to counteract the lateral movement of foot plates 27. A single spring 46 may be connected with its ends hooked in the central holes of the two anchor plates; two springs 46 may connect the outermost holes and with the central spring replaced in its original position, a total of three springs will connect anchor plates 37 and 38. If five holes are provided in each anchor plate and four springs are desired, the central holes are left open and the two outer pairs of holes are connected by tension springs 46, and by replacing the central spring 46 all five tension strings may be employed to provide the maximum self-centering force.

More extreme excursions of foot plates 27 caused by wider swings of the skier's boots from the center line of the device will draw knob slot 43 of the tie bar further to the right or left during each swing, bending cable 39 more sharply around one or the other of the guide rollers 41 until its change of direction approaches a 90 degree or right angle, and the rearward translation of rear spring anchor plate 38 will match the lateral displacement of the tie bar in the outer segments of its lateral travel, maximizing the reaction force supplied by springs 46 to produce self-centering loads tending to draw the tie bar back toward its central position.

This self-centering force simulates the corresponding self-centering force supplied by snow against the bottoms of the tilted skiis at the outermost angular extremes of the skier's side to side slalom course in a downhill ski run. The amount of tilting, rocking motion of ski plates 26 corresponding to the rocking motion of the skiis during such extreme lateral slalom turns is readily indicated by a pair of indicator rods 47 preferably formed of white plastic rod material provided with colored upper knobs if desired having their lower ends inserted in socket holes 48 formed in the forward ends of the respective ski plates 26. As indicated in FIG. 6, outward tilting of ski plates 26 will produce outward swinging motion of rods 47 and inward tilting will tilt rods 47 inward. Thus the skier's desired ankle movement may be continuously adjusted to keep the rods parallel or only slightly converging as desired in a straight downhill run position and in extreme slalom turn positions.

Another indication of the edging angle attained on each slalom turn may be provided by an audible "beeper" oscillator, actuated by an adjustable switch 50 mounted between each truck 31 and the inside edge of its overlying ski plate 26, as shown in FIGS. 4, 5 and 6. The switch may be adjusted to produce the audible edging signal at any rocking angle desired by the user.

When the longer wedging tie bar or the dual-purpose tie bar 58 is employed, the wedging, tilting of the skis toward each other may be accurately controlled by the skier, aided by his observations of the indicator rods 47 whose upper tips traverse a substantial arc for each small increment of angular rocking movement of the ski plates 26 themselves, correspondingly indicating the angle of rocking movement with striking clarity.

To simulate diagonal downhill runs the height adjuster end mounts 24 may be set with their adjusting screws 49 at different levels in their slots 51. As indicated in the drawings, the depending flanges 52 extending downward from the respective outer ends of the rear track 23 overlap the upstanding web 53 of an end mount angle 54 and these overlapping members 52 and 53 are provided with aligned holes and slots in one or the other to permit relative vertical movement, which may be clamped in any adjusted position by bolts 49 passing through the aligned holes and slots, with adjustment nuts or threaded handles anchored thereon.

The rear track 23 may be raised to a steeper angle or a lower, flatter angle by this means, and either end of rear track 23 may be lowered while the other end is raised by this means to simulate a diagonal downhill ski run. This slanted rear track position is also useful with the wedging tie bar 33 to practice controlled sliding, wedging stops employed by many beginning skiers to end their ski runs at the bottom of the slope. This same slanting position of rear track 23 may be employed with the parallel tie bar 28 bringing ski plates 26 parallel to each other to practice so called "deep powder turns".

Figure 15:
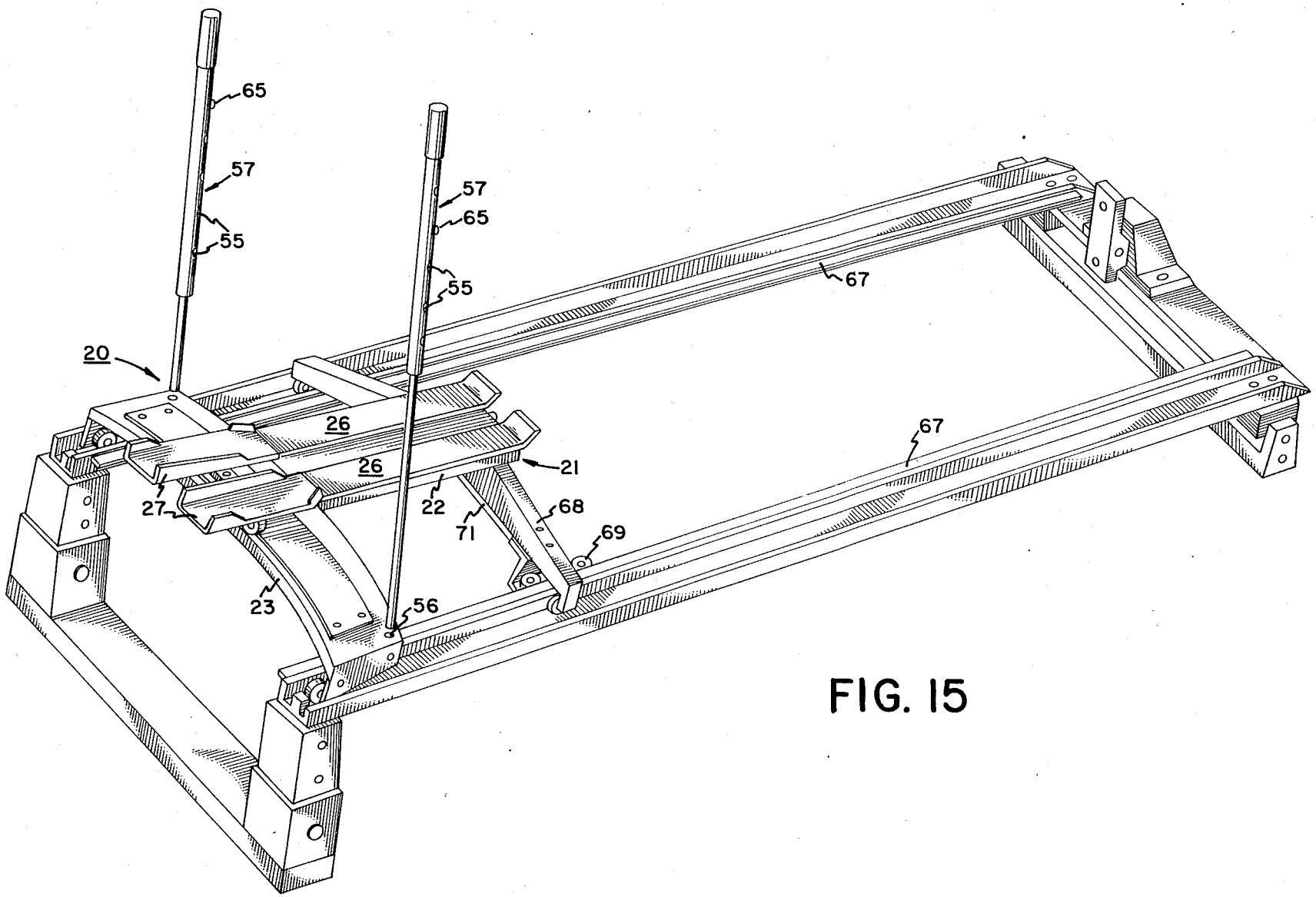
FIG. 15 is a perspective view showing the exercise trainer of the invention mounted for rolling forward movement on a track.

At the ends of rear track 23 and near each forward corner is formed a pole socket 56, in which a ski pole 57 may have its lower end removably engaged for storage, as indicated in FIG. 15. The skier using the device customarily removes the poles and uses them to aid his balance while mounting the foot plates 27, and many skiers use the poles 57 throughout their use of the ski exercise trainer devices of the invention to enhance the realism of the simulated ski run and to aid them in balancing easily as they swing the ski plates 26 from side to side. Poles 57 are preferably formed in two tubular telescoping sections, with the outer section having a series of spaced aligned holes 55 selectively cooperating with a spring biased latch button 65, depressibly installed in the inner tubular section, to adjust the length of each pole 57 as desired.

Figure 10:
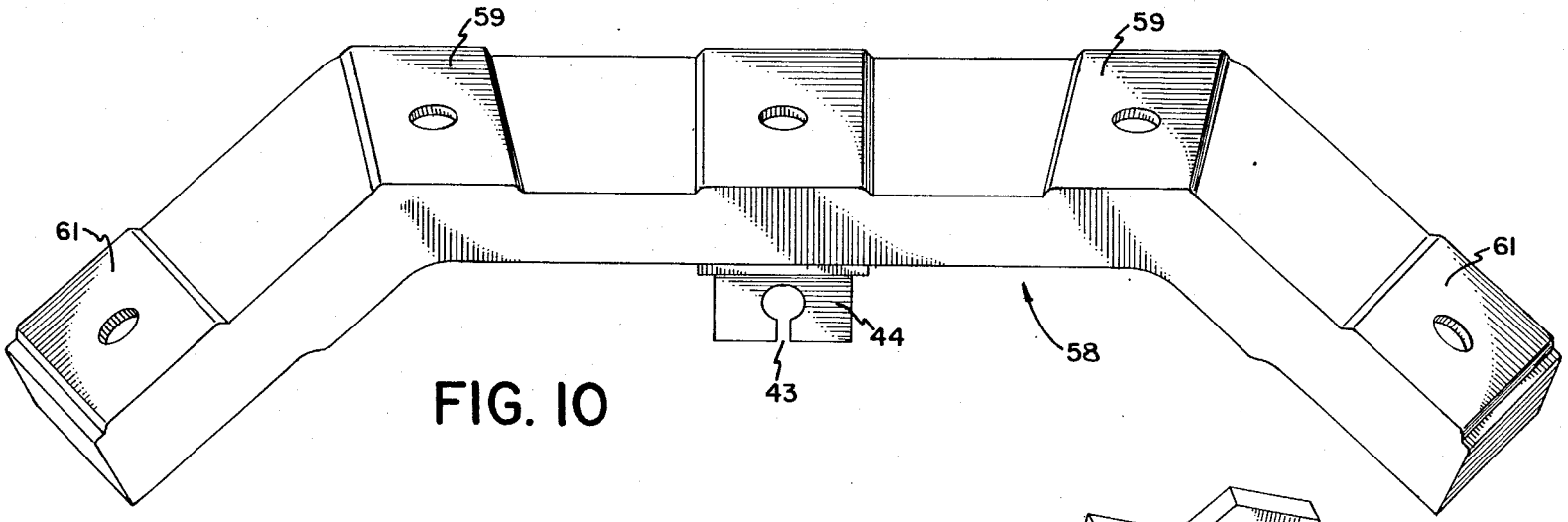
FIG. 10 is an enlarged perspective view of the dual-purpose tie bar of the device.

The choice of tie bars can be simplified if a dual purpose tie bar 58 similar to that shown in FIG. 10 is employed having alternative support bosses at different lateral positions, parallel support pads 59 close to the central knob slot 43 and wedging support pads 61 at the ends of tie bar 58. Pads 59 and 61 are each provided with an aperture in which a depending support post 62 extending downward from the underside of each truck 31 (FIG. 14) can be socketed and the protruding end of each support post 62 is provided with a suitable slot on which a C-ring or snap ring 60 is mounted to secure the post in position in the socket hole provided in pad 59 or 61. As shown in the drawings, the snap rings 60 as mentioned above are preferably provided with an upturned removal flange by which they can be gripped by the user between his fingers without the use of screwdrivers, pliers or other removal tools. This permits simplified manual conversion of the overall ski trainer between the parallel positions of ski plates 26 (FIG. 9) and the angular converging wedging positions of the ski plates (FIG. 8) with the depending support posts 62 of trucks 31 installed in the outermost wedging pads 61 at the ends of the dual purpose tie bar 58.

Figure 11:
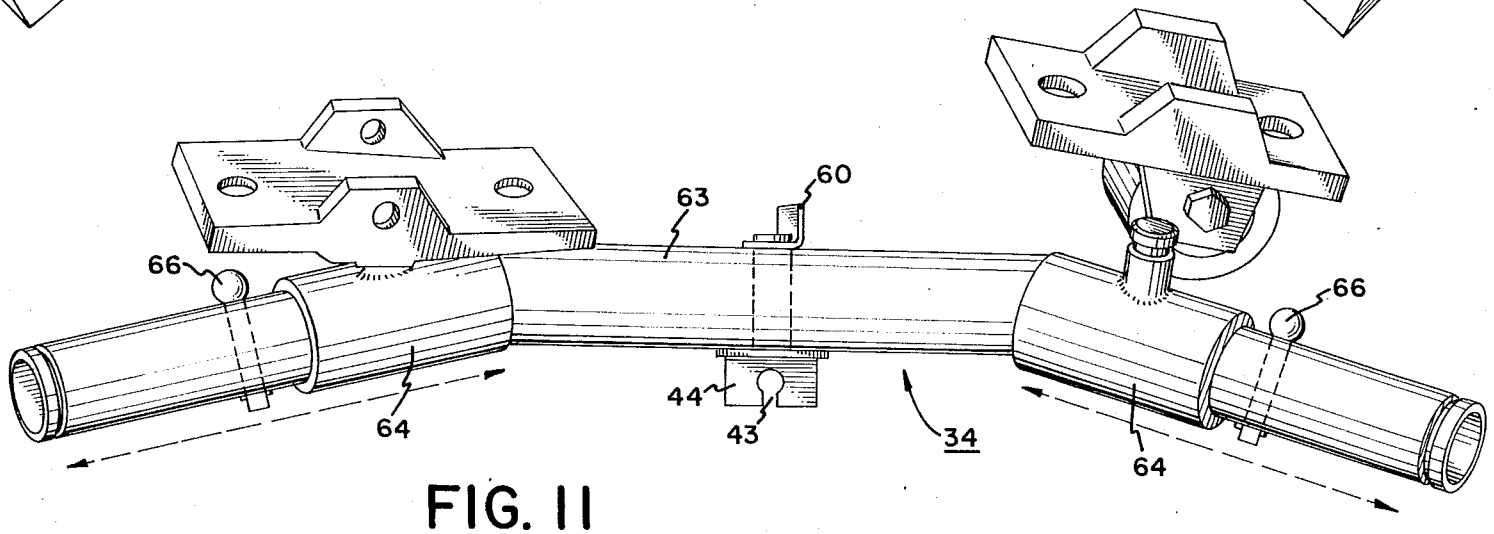
FIG. 11 is a corresponding view of the adjustable tie bar showing the rocking trucks secured thereto.

Still further alternative support for trucks 31 may be provided in the form shown in sliding tie bar 63 in FIG. 11 where the tie bar is a solid or tubular rod having a generally circular cross-section, with sliding sleeves 64 telescopingly movable along its outer portions. Each sleeve 64 is provided with socket corresponding to the aperture pads 59 and 61 receiving the support posts 62 of trucks 31, with similar flanged snap rings or C-rings being installed to secure the trucks to the sleeve 64 and comparable flanged snap rings 60 being mounted at the ends of tie bar 63 to limit the outer travel of sleeve 64 beyond the maximum desired wedging angle. If desired, removable snap pins 66 may also be used to confine sleeve 64 for sliding lateral movement along short outer portion of tie bar 63 or along inner portions closer to the knob slot 43. Such sliding freedom of sleeve 64 to move along tie bar 63 more closely simulates the freedom of the skier's downhill wedging movement, forcing his skiis apart and together. It should be noted that sliding outward movement of sleeve 64 toward the ends of tie bar 63 cause the tie bar to be drawn rearwardly, tensioning cable 39 and extending tension coil springs 46, thus tending to resist the outwardly diverging, wedging movement of the skiis in the same manner that snow resistance is felt by the skier on the slope as he forces his ankles apart and the ski tips toward each other to increase his wedging "snowplow" convergence of the skiis during his downhill run.

Ski plates 26 are each shaped to receive and support an actual snow ski, which can be clamped in place by a belt or Velcro strap cinched Just forward of the boot plate 27. Using actual skiis, ski boots and bindings, the user can apply added leverage and turning power to enhance the realism of the downhill run simulation.

As shown in FIG. 15, a set of track rails 67 may be provided if desired on which the entire base housing 21 is positioned in rolling contact. Both the forward end of the front housing 22 in the vicinity of the pivot mountings 32 and each of the height adjusters 24 at the lateral ends of rear track 23 are mounted on suitable wheels or rollers for progressive rolling movement along track rails 67, whose rear ends may be elevated by simple jacks, such as hydraulic jacks, if desired. When front housing 22 is mounted on a bridging bracket 68, only two tracks are needed to carry the trainer 20, as shown in FIG. 15. By this means, actual forward motion can be achieved as the skier practices his side to side pivoting motion during the progress of the ski training unit 20 along track rails 67, moving in a forward direction.

A braking wheel 69 pivoted at the end of bracket 68 beside track 67 is forced against the track by a brake cable 71, tensioned by the tensioning of springs 46 by wedging separation of ski plates 26 as the user "snowplows" down track 67, employing adjustable tie bar 34 or 63 of FIG. 11. Track 67 can be made in modular segments, providing a longer "ski-run" if desired.

Whether track rails 67 are used or whether the ski trainer 20 is set up in a fixed position on the floor, a mirror may be placed in front of the trainer or at the front end of track rails 67 in which the user may observe his movements and refine or correct his balance and position as he performs the various exercise movements permitted by the trainer.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A skier's exercise trainer comprising a base having a front support and right and left rear lateral supports, and a transverse rear track portion extending laterally between the lateral supports, an elongated right ski plate and an elongated left ski plate positioned side by side overlying the base and having respective front ends individually and rockably pivotally mounted near the front support of the base, and rear ends spaced above the rear track, a truck assembly rockably joined to the underside of the rear end of each said ski plate, an elongated tie bar extending laterally above and across a segment of the rear track, pivotally connected to the underside of each truck, said truck assembles having rolling support means rotatably secured thereto in rolling contact with the rear track, a tension-carrying cable having a rear end connected to the central portion of the tie bar and extending forward under the ski plates, a pair of guide rollers rotatably mounted on the base in front of the tie bar flanking said tension-carrying cable, and an adjustable tension spring assembly connecting the front end of the base to the forward end of said tension-carrying cable, whereby a user standing on the ski plates is enabled to shift his weight from side to side, displacing the two ski plates pivotally sidewise rolling along said rear track in oscillating motion, thereby simulating the motions of a downhill skier making a slalom style run.

2. The exercise trainer defined in claim 1 wherein each truck assembly and its respective ski plate have interposed between them resilient spring means connected to counteract rocking motion of the ski plate relative to the truck assembly and tending to restore the ski plate to its unrocked position.

3. The exercise trainer defined in claim 1 wherein the adjustable tension spring assembly includes a selectable plurality of tension springs removably connected in parallel with each other.

4. The exercise trainer defined in claim 1, further including two rocking angle indicator rods each having a lower end removably secured in a socket positioned facing upward at the front end of each ski plate, and an upper end protruding upwardly in the path of vision of the user of the device, whereby visual indication of the laterally tilted position of each ski plate is readily observed by the user.

5. The exercise trainer defined in claim 1 wherein the tie bar is provided with four separate mounting points offering two different locations for its pivotal connection with each truck, affording a substantially parallel orientation and a substantially non-parallel orientation for the two ski plates.

6. The exercise trainer defined in claim 1 wherein the tie bar is provided with two laterally slidable mounting means offering a plurality of different lateral mounting points for its pivotal connection with each truck, affording a plurality of converging or wedging orientations for the two ski plates.

7. The exercise trainer defined in claims 1, 5 or 6 wherein the pivotal connections between the trucks and the tie bar are detachably secured by snap-action C-rings each having an integral handle tab extending transversely from the plane of said C-ring from a bend-line in said plane, whereby the user's convenient detachment and reinstallation of tie bar pivotal truck connections is facilitated.

8. The exercise trainer defined in claim 1 wherein the right and left rear lateral supports are each provided with vertically adjustable height-varying flanges, whereby the downhill-simulating downslope of the ski plates can be varied, and the ends of the transverse rear track can be set at different heights for simulating diagonal downhill skiing.

9. The exercise trainer defined in claim 1, further including a longitudinal track rollably supporting the base for forward translation movement, and rolling support means guiding the base cooperatively along said longitudinal track, whereby the user's side to side weight shifting movements may be readily performed while the user is being carried by the trainer rolling forward along the track.

10. The exercise trainer defined in claim 9 wherein the longitudinal track is provided with an adjustable elevating support at one end to simulate a downhill ski run.

11. The exercise trainer defined in claim 9, further including braking means cooperatively connected between the longitudinal track and the trainer base rollably supported thereon, and a brake-applying cable operatively connecting the braking means to the forward end of the tension cable, whereby rearward movement of the tension cable actuates said braking means.

12. The exercise trainer defined in claim 9, wherein said longitudinal track is formed of a longitudinal plurality of modular segments.

13. The exercise trainer defined in claim 1 wherein the tension spring assembly is connected to the base by a manually rotatable threaded tension-adjuster.

14. The exercise trainer defined in claim 1, wherein the ski plates are each shaped to support a downhill ski, and further including a cinch strap clamping the ski to its ski plate, whereby the user can use his skiis, boots and bindings while exercising on the trainer for added turning power and realism.

15. The exercise trainer defined in claim 1 wherein the rear track is provided with a pair of pole receiving sockets respectively positioned facing upward near said rear lateral supports, and further including a pair of length-adjustable poles storable in said sockets and readily withdrawable by the user for mounting and moving on the trainer.

* * * * *